US005266734A

United States Patent [19]

Komano et al.

[11] Patent Number: 5,266,734

[45] Date of Patent: Nov. 30, 1993

[54] MUSICAL TONE SYNTHESIZING APPARATUS PERFORMING HIGH-SPEED NON-LINEAR OPERATION

[75] Inventors: Takeshi Komano; Toshifumi Kunimoto, both of Hamamatsu, Japan

[73] Assignee: Yamaha Corporation, Hamamatsu, Japan

[21] Appl. No.: 856,444

[22] Filed: Mar. 24, 1992

[30] Foreign Application Priority Data

Mar. 29, 1991 [JP] Japan ..... 3-91561

[51] Int. Cl.[5] ..... G10H 7/12

[52] U.S. Cl. ..... 84/607; 84/DIG. 9; 84/DIG. 10; 364/723

[58] Field of Search ..... 84/603, 607, DIG. 9, 84/DIG. 10; 364/723, 724.1

[56] References Cited

U.S. PATENT DOCUMENTS 4,984,276 1/1991 Smith .

5,086,475 2/1992 Kutaragi et al. ..... 84/603

FOREIGN PATENT DOCUMENTS 3-48898 3/1991 Japan .

*Primary Examiner*—Stanley J. Witkowski

*Attorney, Agent, or Firm*—Graham & James

[57] ABSTRACT

A musical tone synthesizing apparatus includes an excitation circuit, a resonator circuit, and a resampler. The excitation circuit generates an excitation signal, through a non-linear transformation, in response to an input signal supplied thereto. The resonator circuit resonates the excitation signal supplied thereto. The signal processing in the excitation circuit is executed in synchronization with a high sampling frequency N*Fs. The resampler converts the excitation signal of the high sampling frequency N*Fs into that of a normal frequency Fs. The excitation signal from the resampler, which has the normal sampling frequency Fs, is supplied to the resonator circuit. Accordingly, the resonator circuit can perform its operation at the normal sampling frequency Fs. The high-speed operation of the excitation circuit prevents the abnormal oscillation and the generation of an aliasing noise in the musical tone synthesizing apparatus.

8 Claims, 6 Drawing Sheets

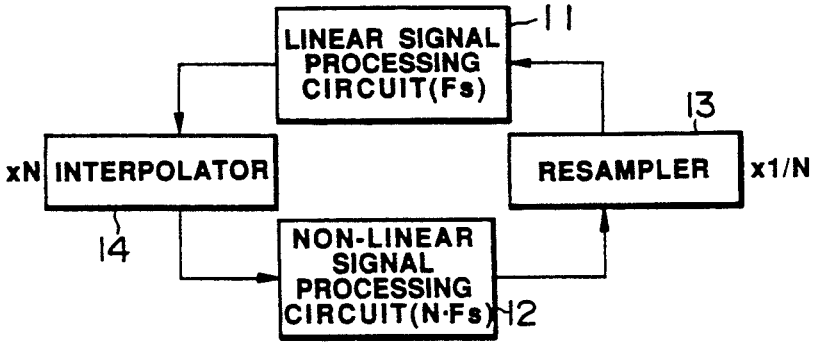
FIG. 1
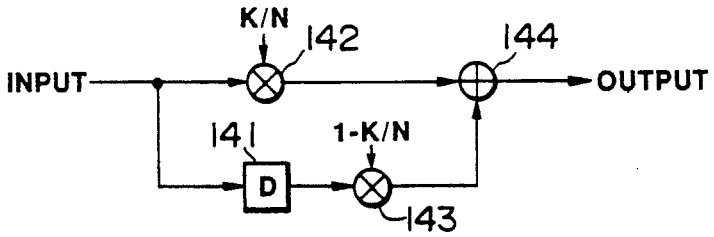
FIG. 2
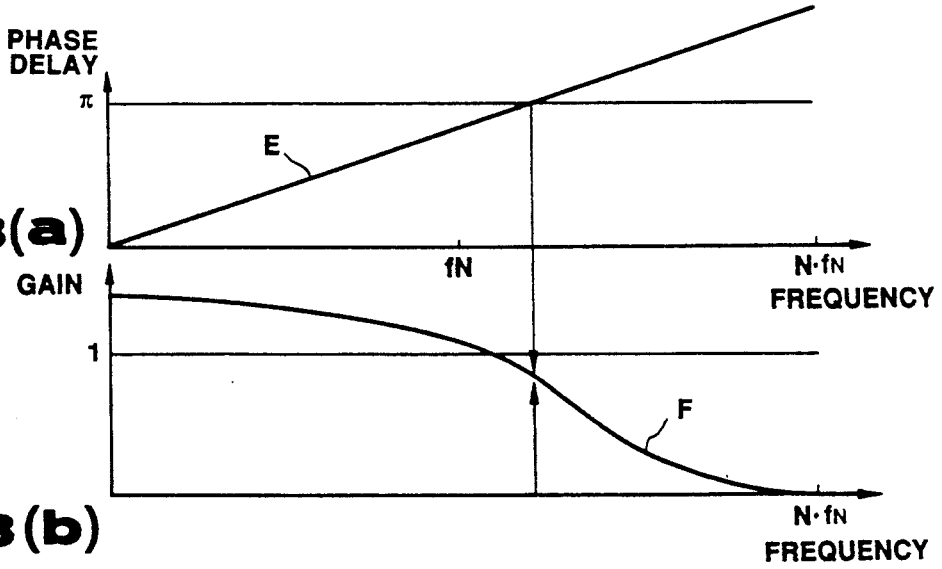
FIG. 3(a)
FIG. 3(b)

MUSICAL TONE SYNTHESIZING APPARATUS PERFORMING HIGH-SPEED NON-LINEAR OPERATION

BACKGROUND OF THE INVENTION

The present invention relates to a musical tone synthesizing apparatus capable of simulating a sound generation mechanism of an acoustic musical instrument.

BACKGROUND ART

Methods for synthesizing the musical sounds of acoustic musical instruments are known in which the mechanism of sound generation in the musical instrument is simulated. For example, in the case where a key of a piano is depressed by a performer, a piano string is struck by a hammer. As a result, the string then vibrates at the natural frequency corresponding to the length of the string. The vibration of the string propagates through air as a piano sound. In consideration of the tone generation mechanism of the piano as described above, the musical tone synthesizing apparatus for synthesizing the piano sounds is designed. This musical tone synthesizing apparatus includes an excitation circuit which simulates the excitation in which the string is struck by the hammer and an resonator circuit which simulates the resonance characteristics of the string. In the resonator circuit, there are provided a delay circuit having the delay time corresponding to the length of the string and a low-pass filter which simulates the frequency characteristics of the acoustic loss of the string in such a manner that the delay circuit and the low-pass filter form a closed-loop. A non-linear transformation circuit is provided in the excitation circuit to simulate a non-linear element of the excitation mechanism. For simulating the excitation mechanism of a piano, a non-linear transformation circuit is provided to simulate such a non-linear characteristic as the elasticity of the hammer. This non-linear transformation circuit outputs a signal corresponding to the displacement of a string caused by the hammer. The output signal of the non-linear transformation circuit is supplied to the resonance circuit as an excitation signal.

In general digital signal processing circuits, signal operations are executed in synchronization with a sampling frequency of a system clock having a predetermined frequency. When the frequency of the system clock is not sufficiently higher than the highest frequency of the input signal supplied to the digital signal processing circuit, an aliasing noise generates on the result of the signal processing. In the above musical tone synthesizing apparatus, there arises a problem that musical tones having an aliasing noise may generate in the case where the sampling frequency of the apparatus is not sufficiently high. Furthermore, a non-linear circuit is apt to output a signal including higher frequency components. In the above apparatus, therefore the aliasing noise may generate at a high probability.

When the musical tone synthesizing apparatus consists of digital circuits, there is a problem that it is difficult to control the frequency of the synthesized musical tone precisely. The description of this problem will follow. In the digital musical tone synthesizing apparatus, the delay circuit in the resonator circuit is constituted by a plurality of unit delay circuits connected in a cascade manner which are driven by a common clock having a constant frequency. In order to control the frequency of the synthesized musical tone, the stage number of the unit delay circuits is determined in such a manner that the total delay time of the unit delay circuits nearly equals the period of the musical tone to be synthesized. Generally, however, the stage number of the unit delay circuits desired is a real number including an integer portion and a fractional portion. An interpolator is connected to the unit delay circuits in order to achieve a delay operation corresponding to the delay time of the fractional portion of the desired stage number. The resonance frequency of the resonator circuit can have a desired resonance frequency by setting the total delay time to be realized by the connected unit delay circuits and the interpolator. However, the resonance circuit and the excitation circuit are connected so as to form a closed-loop in order to accurately simulate the tone generation mechanism of a piano. In this case, the forward signal transmission that a signal from the excitation circuit is transmitted to the resonance circuit and the reverse signal transmission that a signal from the resonance circuit is transmitted to the excitation circuit are executed in synchronization with a common sampling clock of a predetermined sampling frequency. In such a case, specified components having frequencies of which are integer multiples of the sampling frequency are likely to be emphasized in the synthesized musical tone. For this reason, the frequency of the synthesized musical tone cannot be controlled accurately even if the total delay time is accurately set to the target delay time corresponding to the desired musical tone frequency by adjusting the interpolator implementing a fractional delay time.

Furthermore, there is a problem of a phase rotation generated in the excitation circuit and an abnormal oscillation due to the phase rotation may be easily established in the excitation circuit. The description of this problem will follow. In a digital excitation circuit, a non-linear calculation is executed in synchronization with a sampling clock having a predetermined sampling frequency and the signals which represent the states of the portions of the excitation mechanism are updated based on the result of the non-linear calculation. For example, in the excitation circuit for simulating the interaction between the hammer and the string in a piano, a non-linear calculation is executed in each sampling period based on the current parameters such as the positions, the velocities and the accelerations of the hammer and the string. The results of the calculations are used for the non-linear calculation as the parameters in the next sampling period. In order to achieve such a sequential control, it is necessary that the digital excitation circuit has a closed-loop configuration including a delay circuit therein as shown in FIG. 11. In FIG. 11, 1 designates an adder; 2 designates a non-linear calculation circuit; and 3 designates a one-sampling-period delay circuit. 4 designates a multiplier controlling a feedback ratio. These elements 1 through 4 are connected so as to form a closed-loop. An input signal is supplied to one of the input terminals of adder 1. Non-linear circuit 2 carries out a non-linear calculation on the output signal of adder 1. The calculation result of non-linear calculation circuit 2 is delayed by one-sample-delay circuit 3 by a predetermined sampling period. In each sampling period, the output signal of one-sampling period delay circuit 3 indicates the state of the corresponding portion of the excitation mechanism during the last sampling period. The output signal of one-sampling-period delay circuit 3 is multiplied by a predetermined coefficient by multiplier 4. The output signal of multiplier 4 is supplied to the other input terminal of adder 1. In the above configuration, during the circulation in which an input signal propagates through the closed-loop, a phase delay due to the delay time of delay circuit 3 is applied to the input signal. FIG. 12(*a*) shows the frequency characteristic of the phase delay of the closed-loop. FIG. 12(*b*) shows the frequency characteristics of the loop gain of the closed-loop. The phase delay applied to the input signal is proportional to the signal frequency as shown by line A in FIG. 12(*a*). The gain of the closed-loop circuit gradually decrease in response to the increase of the signal frequency as shown by curve B in FIG. 12(*b*). When the loop gain is more than [1] at the frequency $F_N$ at which the phase delay of the closed-loop is $\pi$, an oscillation arises in the closed-loop. This causes a calculation error in the excitation circuit. In order to prevent the oscillation, a low-pass filter is inserted in the closed-loop so that the loop-gains in high frequency band can decrease as indicated by curve C in FIG. 12(*b*). However, it is not so effective for the prevention of the oscillation to insert the low-pass filter because the phase delay of the closed-loop increase as indicated by line D so that frequency $f_N$ at which the oscillation may arise decreases.

SUMMARY OF THE INVENTION

In consideration of the above, it is an object of the present invention to provide a musical tone synthesizing apparatus having the following advantages:

(1) Aliasing noise in the synthesized musical tone is at a very low level.

(2) Accurate control of the musical tone frequency is implemented.

(3) Oscillation during the calculation is prevented and the stable operation is obtained.

In an aspect of the present invention, there is provided a musical tone synthesizing apparatus comprising:

a linear signal processing circuits which carries out a linear signal processing including at least a delay operation on an input signal supplied thereto and outputs the result of the linear signal processing as an output signal in synchronization with a clock having a first frequency;

a non-linear calculation circuit which carries out a non-linear calculation on an input signal supplied thereto and outputs the result of the non-linear calculation as an output signal in synchronization with a high-rate clock having a second frequency greater than the first frequency; and a resampler which converts the output signal of the non-linear signal processing circuit into a signal, the sampling frequency of which is the first frequency, and supplies the signal obtained by the conversion to the linear signal processing means as the input signal in synchronization with the clock having the first frequency;

whereby a signal picked up from the linear signal processing circuit is output as a musical tone signal.

Further objects and advantages of the present invention will be understood from the following description of the preferred embodiments with reference to the drawing.

BRIEF DESCRIPTION OF THE DRAWING

FIG. 1 is a block diagram showing a basic configuration of a musical tone synthesizing apparatus of the present invention.

FIG. 2 is a block diagram showing the configuration of an interpolator employed in the musical tone synthesizing apparatus of the present invention.

FIGS. 3(*a*) and 3(*b*) are graphs respectively showing the phase delay and the gain of the musical tone synthesizing apparatus of the present invention.

DETAILED DESCRIPTION OF THE PREFERRED EMBODIMENTS

[1]Basic configuration of the present invention

Figure 4:
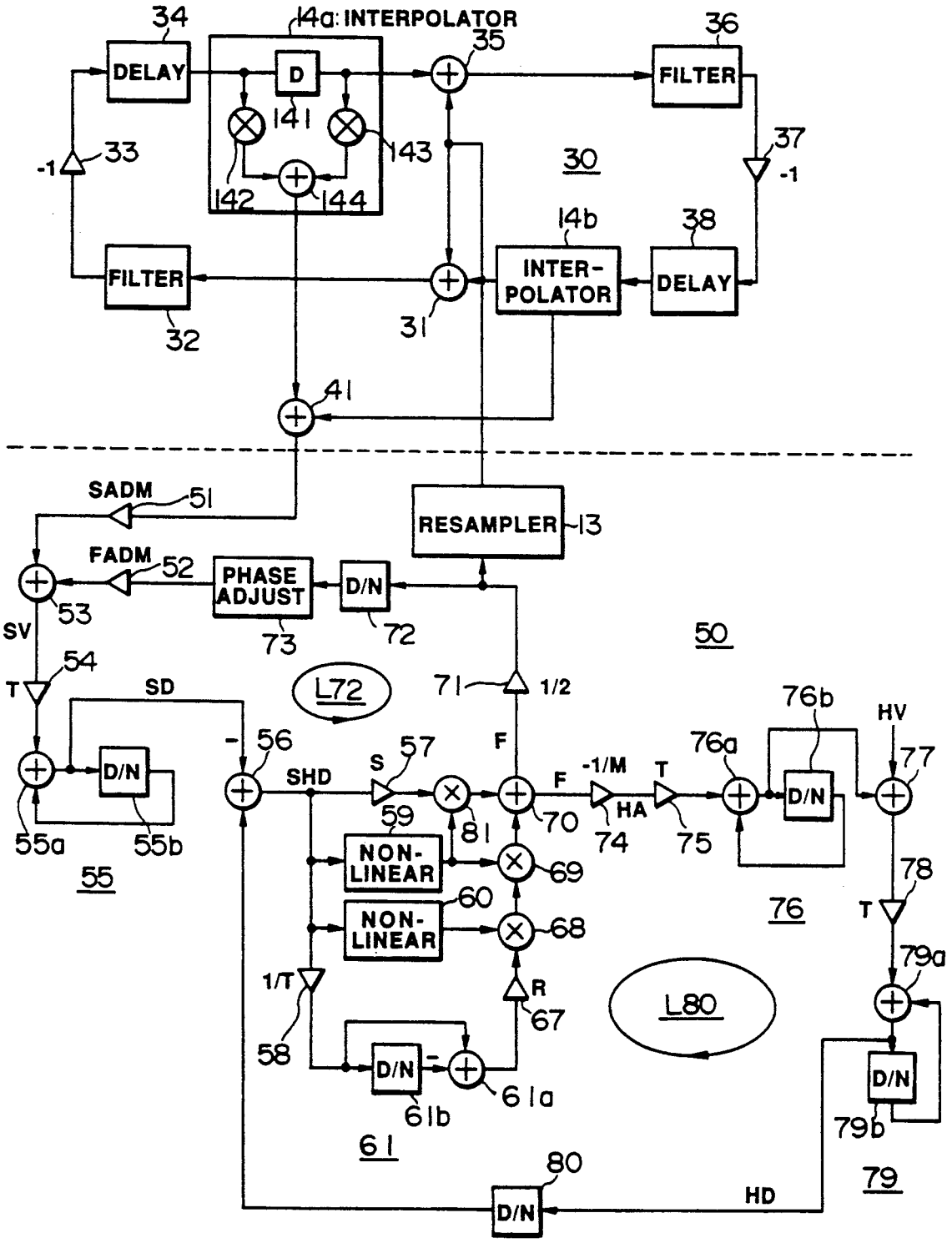
FIG. 4 is a block diagram showing the configuration of a musical tone synthesizing apparatus of the first preferred embodiment.

FIG. 1 is a block diagram showing the basic configuration of a musical tone synthesizing apparatus of the present invention. In FIG. 1, 11 designates a linear signal processing circuit which simulates the operation of the resonator of a non-electronic musical instrument. Linear signal processing circuit 11 provides a delay circuit and a filter and thereby carries out a delay operation and a filtering operation on an input signal supplied thereto. A clock having a predetermined sampling frequency Fs is supplied to linear signal processing circuit 11. The operation of each portion in signal processing circuit 11, for example, the delay operation or the filtering operation is controlled in synchronization with this clock. 12 designates a non-linear signal processing circuit which simulates the operation of the excitation mechanism of the non-electronic musical instrument. A high-rate clock having a sampling frequency N*Fs (N indicates a integer number and * indicates a multiplication operation) is supplied to non-linear signal processing circuit 12. The operation of each portion in non-linear signal processing circuit 12 is controlled in synchronization with this high-rate clock. Non-linear signal processing circuit 12 calculates and outputs an excitation signal in synchronization with the clock having the sampling frequency N*Fs. 13 designates a resampler. This resampler converts the excitation signal having the sampling frequency N*Fs into a signal having sampling a frequency Fs. The output signal of resampler 13 is supplied to linear signal processing circuit 11. 14 designates an interpolator which interpolates the output signal of linear signal processing circuit 11 over time through an interpolation such as an linear interpolation to convert the output signal having sampling frequency Fs into a signal having a sampling frequency N*Fs. The output signal of interpolator 14 is fed back to non-linear signal processing circuit 12. The simulation model shown in FIG. 1 is used for simulating the bi-directional mode of transmission of vibration between an excitation mechanism and a resonator. When simulating only one vibration transmission mode in which vibration transmits from an excitation to a resonator, interpolator 14 is not necessary.

FIG. 2 shows the configuration of an example of interpolator 14. This interpolator is provided with delay circuit 141, multipliers 142 and 143 and adder 142. A signal to be interpolated is supplied to delay circuit 141 and multiplier 142. Delay circuit 141 delays the input signal by one sampling period 1/Fs. The output signal of delay circuit 141 is supplied to multiplier 143. The output signals of multipliers 142 and 143 are summed by adder 144. One sampling period, the interval of which is 1Fs, is divided into time slots, each interval is 1/(N*Fs). Time slot numbers $k=0$ through $N-1$ are assigned to the time slots included in the sampling period. Multiplication coefficients supplied to multipliers 142 and 143 are changed over time in synchronization with the changing of the time slot in such a manner that multiplication coefficients k/N and 1-k/N are supplied respectively to multipliers 142 and 143 during the time slot No. k. Accordingly, when the input signal currently supplied is $X_i$ and the output signal of delay circuit 141, which was supplied to the interpolator before one sampling period, is $X_{i-1}$, adder 141 outputs $X_i$ during the time slot No. 0, $(1/N)*X_i+\{1-(1/N)\}*X_{i-1}$ during the time slot No. 1, $(2/N)*X_i+\{1-(2/N)\}*X_{i-1}$ during the time slot No. 2, . . . , $\{(N-1)/N\}*X_i+(1/N)*X_{i-1}$ during the time slot No. $N-1$. In this manner, the output signal of adder 141 sequentially varies from $X_{i-1}$ to $X_i$ in synchronization with the changing of time slot.

In the configuration shown in FIG. 1, the operation of non-linear circuit 12 is executed in synchronization with sampling frequency N*Fs. Noise level included in the output signal of non-linear signal processing circuit 12 is reduced in comparison with a case in which the operation of non-linear circuit is executed in synchronization with sampling frequency Fs. Thus, the influence on the resonance frequency of linear signal processing circuit 11 due to the noise generated by non-linear signal processing circuit 12 is reduced. The tone pitch of the synthesized musical tone can be accurately controlled. Furthermore, in non-linear signal processing circuit 12, one sampling period is 1/N of the sampling period corresponding to the sampling frequency Fs. In the case where a closed-loop including a delay circuit is provided in non-linear signal processing circuit 12 and a signal circulates through the closed loop, the phase delay is applied to the signal by the delay circuit. However, this phase delay is lower in comparison with the case of sampling frequency Fs because the delay time of the delay circuit is 1/N of that in the case of sampling frequency Fs. Thus, although a low-pass filter for preventing the oscillation is inserted in the closed-loop, the total phase delay of the closed-loop in response to the signal frequency can be kept low as indicated by line E in FIG. 3(*a*). For this reason, the loop gain at the frequency at which the total phase delay of the closed-loop is $\pi$ can be decreased to a value less that [1] as indicated by curve F in FIG. 3(*b*) so that the oscillation cannot be generated.

[2] First preferred embodiment

Figure 5:
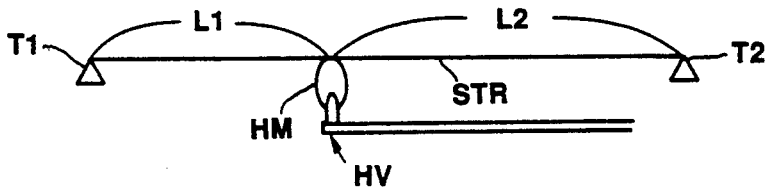
FIG. 5 shows a hammer and a string, the operations of which are simulated by the musical tone synthesizing apparatus of the first preferred embodiment.

FIG. 4 is a block diagram showing the configuration of a musical tone synthesizing apparatus of the first preferred embodiment. This musical tone synthesizing apparatus synthesize a piano tone through the simulation of the operation of hammer HM and string STR shown in FIG. 5. In FIG. 4, 30 designates a loop circuit for simulating the movement of string STR. 50 designates an excitation circuit for simulating the movement of hammer and the interaction between hammer HM and string STR. Loop circuit 30 is provided with adder 31, filter 32, phase invertor 33, delay circuit 34, interpolator 14*a*, adder 35, filter 36, phase invertor 37, delay circuit 38 and interpolator 13*b*. These elements in loop circuit 30 are connected so as to form a closed-loop. Delay circuits 34 and 38 delay the input signals by a desired delay stage number which is a real number having a integral portion and a fractional portion. Delay circuits 34 and 38 include a multi-stage shift register for the delay operation corresponding to the integral portion of the desired delay stage number. The shift operation of each shift register is executed in synchronization with a clock having a sampling frequency Fs. Thus, the input signals to delay circuits 34 and 38 are delayed by these shift registers by the delay time which is obtained by multiplying the sampling period 1/Fs by the integral portion of the desired delay stage number. Delay circuits 34 and 38 further include an interpolator for the delay operation corresponding to the fractional portion of the desired delay stage. The interpolator interpolates its output signal based on the output signals of predetermined stages in the shift register. Interpolators 34 and 38 over-sample the signal which circulates in loop circuit 30 at a sampling frequency Fs to output the N interpolated signals during each sampling period. These interpolators have the same configuration as the configuration shown in FIG. 2. The output signal of delay circuit 34 is supplied to one of the input terminals of adder 35 via delay circuit 141 in interpolator 14*a* while the output signal of delay circuit 38 is supplied to the one of the input terminals of adder 31 via delay circuit (not shown) in interpolator 14*b*.

Resampler 13 is provided in excitation circuit 30. This resampler outputs a signal having a sampling frequency Fs and the output signal is supplied to the other input terminals of adders 31 and 35. Adder 144 in interpolator 14*a* and the adder in interpolator 14*b* output signals having sampling frequency N*Fs. These output signals are summed by adder 41. The added result is supplied to excitation circuit 50. The elements described above and used for the signal transmission between loop circuit 30 and excitation circuit 50 correspond to the struck point of string STR which is struck by hammer HM. More specifically, the total delay time of the signal path from the input terminal of adder 36 to the output terminal of interpolator 14*a* corresponds to the delay time which is required for the vibration to reciprocate through a portion of string STR (length L1) between the struck point and fixed terminal T of string STR. On the other hand, the total delay time of the signal path from the input terminal of adder 35 to the output terminal of interpolator 14*b* corresponds to the delay time which is required for the vibration to reciprocate through the other portion of string STR (length L2) between the struck point and the other fixed terminal T2 of string STR. Phase invertors 33 and 37 are provided for simulating a phase inversion phenomenon in which when a vibration wave is reflected at the terminal T1 or T2, the phase of the vibration waveform is inverted. Filters 32 and 36 are provided for simulating the frequency characteristics of the acoustic loss corresponding to an energy which is lost in the case where the vibration waveform is transmitted to the reverberation board of a piano and a energy which is lost in the case where the vibration waveform is transmitted from the string of the piano to air. Generally, the acoustic loss is large in the case where the frequency of the acoustic wave is high. For this reason, low-pass filters are used as filters 32 and 36.

Next, the configuration of excitation circuit 50 will be described. Integrator 55 consisting of adder 55*a* and delay circuit 55*b*; integrator 76 consisting of adder 76*a* and delay circuit 76*b*; integrator 79 consisting of adder 79*a* and delay circuit 79*b*; differentiator 61 consisting of subtractor 61*a* and delay circuit 61*b*; and delay circuits 72 and 80 are provided in excitation circuit 50. These delay circuits provided in excitation circuit 50 are driven by a clock having a sampling frequency N*Fs. Some closed-loops are formed in excitation circuit 50. All closed-loops have a loop delay time corresponding to the sampling period. Multipliers 54, 75 and 78 having multiplication coefficients, T, are respectively provided in front of integrator 55, 76 and 79. Multipliers 58 having a multiplication coefficient 1/T is provided in front of differentiator 61. Coefficient T corresponds to one sampling period, and is determined by $T=1/(N^*Fs)$.

Hammer velocity signal HV is supplied to one input terminal of adder 77. This signal corresponds to the velocity of hammer HM which comes into contact with string STR. The integrated value in integrator 76 is supplied to the other input terminal of adder 77 from adder 76*a*. This integrated value corresponds to the velocity variation of hammer HM which is caused through the interaction between hammer HM and string STR. The calculation for determining the velocity variation will be described later. The output signal of adder 77 corresponds to the velocity of hammer HM, and is multiplied by T by multiplier 78. The output signal of multiplier 78 is integrated in integrator 79. The integrated value in integrator 79 is output as hammer displacement signal HD which corresponds to the displacement of hammer HM.

On the other hand, multiplier 51 multiplies the output signal of adder 41 by coefficient SADM. The multiplied result of multiplier 51 and the output signal of multiplier 52 are summed by adder 53. The output signal of multiplier 51 corresponds to the velocity of string STR at the struck point, while the output signal of multiplier 52 corresponds to the variation in the velocity of string STR. Adder 53 adds the output signals of these multipliers and then outputs signal SV corresponding to the new value of the velocity of string STR. Signal SV is multiplied by T by multiplier 54. The multiplied result of multiplier 54 is integrated in integrator 55. The integrated value in integrator 55 is output from adder 55*a* as string displacement signal SD which corresponds to the displacement of string STR. String displacement signal SD is supplied to the negative input terminal of subtractor 56. On the other hand, hammer displacement signal HD is delayed by one sampling period by delay circuit 80 and the delayed signal is supplied to the plus input terminal of subtractor 56. Subtractor 56 calculates the subtraction HD-SD and outputs the result as relative displacement signal SHD. Relative displacement signal SHD corresponds to the deflection of hammer HM.

Figure 6:
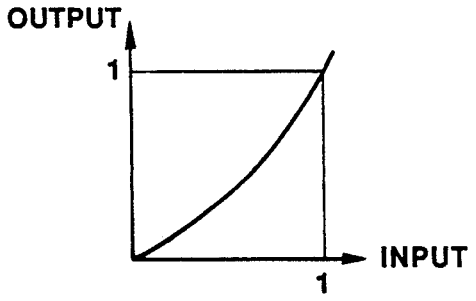
FIGS. 6 and 7 show non-linear transformations which are executed in the first preferred embodiment.
Figure 7:
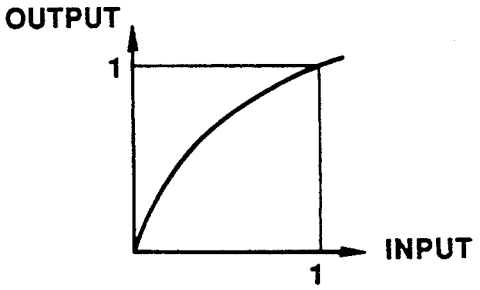

Relative displacement signal SHD is supplied to non-linear transformation circuits 59 and 60 directly, and to differentiator 61 via multiplier 61. As non-linear transformation circuits 59 and 60, ROMs (Read Only Memories) can be used. FIG. 6 shows an example of the input to output transformation characteristic of these non-linear transformation circuits. The output signals of non-linear circuits 59 and 60 gradually increase in response to the increase of the input signals as illustrated in FIG. 6. Multiplier 57 multiplies relative displacement signal SHD by a coefficient S corresponding to the elastic coefficient of hammer HM. The output signal of multiplier 57 is multiplied by the output signal of non-linear circuit 59 by multiplier 81. As a result, multiplier 81 outputs a signal which corresponds to the reactive force interacting between hammer HM and string STR, and is generated due to the elasticity of hammer HM. The output signal of multiplier 81 increases in response to the increase of the level of relative displacement signal SHD. On the other hand, relative displacement signal SHD is multiplied by 1/T by multiplier 58. The multiplied result of multiplier 58 is differentiated by differentiator 64. The differentiated result of differentiator 64 is multiplied by a coefficient R by multiplier 67. This coefficient corresponds to the viscosity of hammer HM. The output signal of multiplier 67 is multiplied by the output signals of non-linear transformation circuits 68 and 69 by multipliers 68 and 69. By these two multiplication, the output signal from multiplier 67 is multiplied with the signal SHD operated by non-linear transformation shown in FIG. 7 and is output from multiplier 69. The output signal of multiplier 69 corresponds to the reactive force between hammer HM and string STR generating due to the viscosity of hammer HM. The value of the output signal of multiplier 69 increases in response to the increase of the value of relative displacement signal SHD or the increase of the variation ratio over time of relative displacement signal SHD. In this manner, an operation of hammer HM and string STR due to the viscosity of hammer HM is accurately simulated in which the large reactive force is generated between hammer HM and string STR when string STR goes into hammer HM in deep or when string STR and hammer HM come into contact at high speed. The output signals of multipliers 57 and 69 are summed by adder 70. The added result of adder 70 is output as reactive force signal F corresponding to the reactive force interacting between hammer HM and string STR.

Multiplier 71 multiplies reactive force signal F by ½ and outputs the multiplied result F/2 as the output signal. This output signal corresponds to each velocity of the vibration signals, one of which propagates from the struck point toward the one of the fixed terminals, and the other of which propagates from the struck point toward the other terminal portion. The output signal of multiplier 71 has sampling frequency N*Fs and is converted into a signal having sampling frequency Fs by resampler 13. The output signal of resampler 13 having sampling frequency Fs is fed back to adders 32 and 36 in loop circuit 30. On the other hand, the output signal of multiplier 71 is supplied to multiplier 52 via delay circuit 72 and phase adjust filter 73. Multiplier 52 then multiplies the input signal from multiplier 71 by coefficient FADM, and outputs the multiplied result as the output signal which corresponds to the variation of the velocity of string STR generated by hammer HM. Loop L72 includes delay circuit 72 and the total delay time required for circulating a signal in loop L72 once is 1/(N*Fs). The abnormal oscillation in loop L72 can be sufficiently prevented because the phase delay corresponding to delay time 1/(N*Fs) is very low and the higher components included in the signal circulating in loop L72 is attenuated by phase adjust filter 73. Multiplier 74 multiplies reactive force signal F by a coefficient −1/M and then outputs the multiplied result −F/M as output signal HA. In coefficient −1/M, M corresponds to mass of hammer HM. Accordingly, the output signal HA indicates the acceleration generated in hammer HM. Signal HA is supplied to integrator 76 via multiplier 75 and is thereby integrated. As a result, a signal corresponding to the variation of the velocity of hammer HM as mentioned above is obtained through the integration of integrator 56 and is supplied to adder 77. Excitation circuit 50 has loop L80 including delay circuit 80. The total loop delay time of loop L80 is 1/(N*Fs). Accordingly, the abnormal oscillation cannot occur in loop L80.

In the musical tone synthesizing apparatus as described above, excitation circuit 50, including a non-linear calculation element, is controlled in synchronization with the high rate sampling clock having a sampling frequency N*Fs. As a result, the noise included in the signal generated by excitation circuit 50 is reduced. The output signal of excitation circuit 50, having sampling frequency N*Fs, is converted into a signal having sampling frequency Fs by resampler 13. The output signal of resampler 13, having sampling frequency Fs, is then supplied to loop circuit 30. As a result, resonation occurs in loop circuit 30. The resonation is performed at the frequency which accurately corresponds to the total loop delay time set to loop circuit 30. Thus, a musical tone having a desired tone pitch is synthesized. Loops such as L72 and L80 are formed in excitation circuit 50. However, the total loop delay time of each loop is 1/(N*Fs), and the phase delay corresponding to 1/(N*Fs) is very small. Accordingly, abnormal oscillation cannot occur in these loops. In this manner, the occurrences of abnormal operations are prevented in the musical tone synthesizing apparatus. Accordingly, the apparatus does not fall in the abnormal state and the stable operation is obtained in the apparatus.

[C] Second Preferred Embodiment

Figure 8:
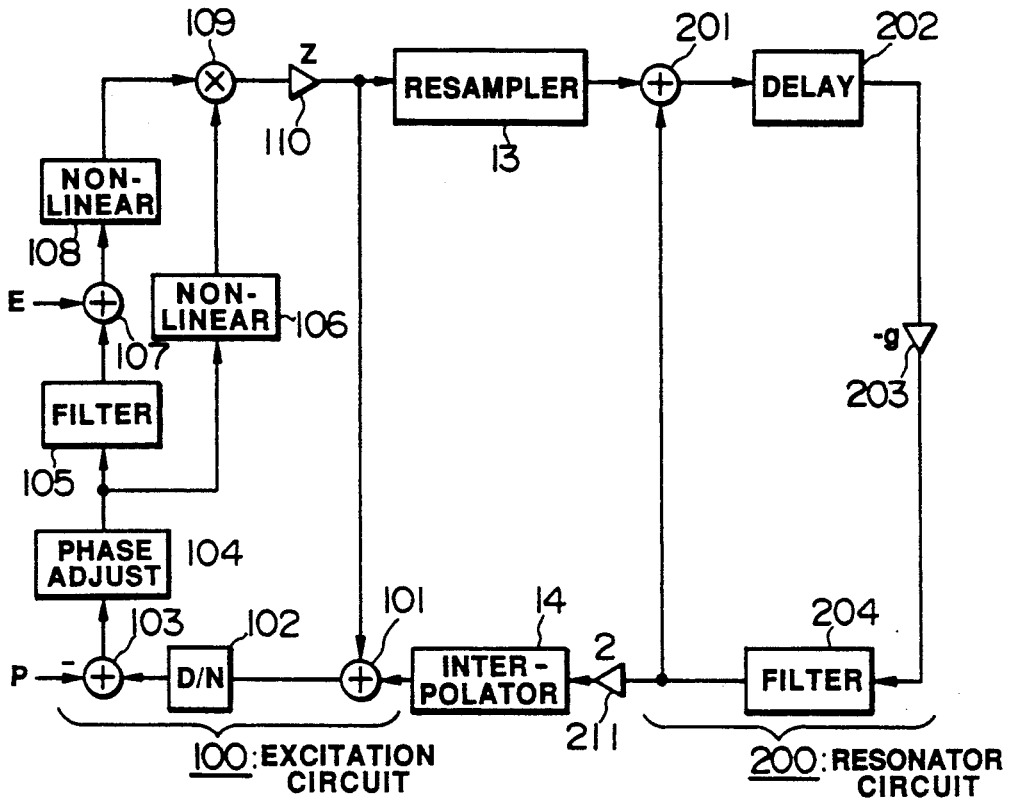
FIG. 8 is a block diagram showing the configuration of a musical tone synthesizing apparatus of the second preferred embodiment.

FIG. 8 is a block diagram showing the configuration of a musical tone synthesizing apparatus of the second preferred embodiment. This apparatus is designed to synthesize a musical tone of a non-electronic wind instrument. In FIG. 8, 100 designates an excitation circuit which simulates the operation of the excitation mechanism of the wind instrument, i.e., the operation of the mouth piece. 200 designates a resonator circuit which simulates the operation of the resonator tube of the wind instrument.

In resonator circuit 200, adder 201; delay circuit 202 which has a delay time corresponding to the length of the resonator tube to be simulated; multiplier 203 to which a multiplication coefficient −g is given; and filter 204 for simulating an acoustic loss of the resonator tube are provided and connected together so as to form a closed-loop. Delay circuit 202 delays the input signal by a desired delay stage number which is a real number having an integral portion and a fractional portion. The delay circuit having a multi-stage shift register and an interpolator, which is used for the first preferred embodiment, is preferably employed as delay circuit 202. In this case, the delay operation of each stage of the shift register is triggered in synchronization with a clock having a sampling frequency Fs. The output signal of filter 204 in resonator circuit 200 is supplied to the one of the input terminals of adder 201. The output signal of filter 204 is also supplied to multiplier 211 and is thereby multiplied by 2. The multiplied result of multiplier 211 is converted to a signal having sampling frequency N*Fs by interpolator 14. The output signal of interpolator 14, having sampling frequency N*Fs, is supplied to one of the input terminals of adder 101 in excitation circuit 101.

In excitation circuit 100, adder 101 outputs a signal corresponding to the pressure of the air pressure wave which is fed back into the mouth piece from the resonator tube. The output signal of adder 101 is delayed by delay time 1/(N*Fs) by delay circuit 102, the delay operation of which synchronizes with a high-rate clock having sampling frequency N*Fs. Subtractor 103 subtracts a value P corresponding to the blowing pressure from the output signal of delay circuit 102 and outputs the subtracted result which corresponds to the air pressure in the mouth piece. The output signal of subtractor 103 passes through phase adjust filter 104. The high frequency components included in the output signal of subtractor 103 is thereby rejected. The signal past through phase adjust filter 103 is supplied to filter 105 and to non-linear transformation circuit 106. Filter 105 has a transmission frequency characteristic corresponding to the frequency characteristic of the dynamic response of the reed responding to the variation of the air pressure in the mouth piece. A low-pass filter is preferably employed as filter 105. Non-linear transformation circuit 106 has a non-linear input-output transformation characteristic corresponding to a saturation characteristic which is determined based on the relationship between the velocity of an air flow and the air pressure. Adder 107 adds the output signal of filter 105 with embouchure signal E corresponding to the pressure at which a performer holds the mouth piece between his or her teeth. Adder 107 then outputs the added result as an output signal corresponding to the pressure which is applied to the reed. The output signal of adder 107 is supplied to non-linear transformation circuit 108 having a non-linear input-output transformation characteristic which simulates the relationship between the variation of the pressure applied to the reed and the variation of the sectional area of the slit formed between the reed and the mouth piece. The output signal of non-linear transformation circuit 108, corresponding to the sectional area of the slit, is multiplied by the output signal of non-linear transformation circuit 106 by multiplier 109. Multiplier 109 outputs the multiplied result as an output signal. This output signal corresponds to the velocity of the air flow passing through the slit between the reed and the mouth piece. Multiplier 110 multiplies the output signal of multiplier 109 by a coefficient Z corresponding to the impedance for air flow in the vicinity of the connecting portion of the mouth piece. As a result, a signal, corresponding to the variation of the air pressure in the connecting portion, is output by multiplier 109. The output signal of multiplier 109 is supplied to the other input terminal of adder 101. The output signal of multiplier 109 is also supplied to resampler 13, and is thereby converted into an excitation signal having sampling frequency Fs. The output signal of resampler 13 is then supplied to the other input terminal of adder 201 in resonator circuit 200.

In the musical tone synthesizing apparatus as described above, bi-directional signal transmission is performed by excitation circuit 100 and resonator circuit 200, and a continuous musical tone signal is obtained from resonator circuit 200. The level of the noise included in the excitation signal, which is supplied to resonator circuit 100, is very low because the operations in excitation circuit 100 are executed in synchronization with the high-rate clock having sampling frequency N*Fs. Accordingly, resonator circuit 200 resonates at the frequency which accurately corresponds to the resonance frequency of resonator circuit 200 set in account of the tone pitch of a desired musical tone. Excitation circuit 100 has a closed-loop. However, there is only delay circuit 102 which has a delay time is 1/(N*Fs), and the phase delay corresponding to 1/(N*Fs) is very low. Furthermore, phase adjust filter 104 is inserted in the closed-loop to reject high frequency components from the circulating signal in the closed-loop. Thus, abnormal oscillation in the closed-loop is prevented.

[D] Third preferred embodiment

Figure 9:
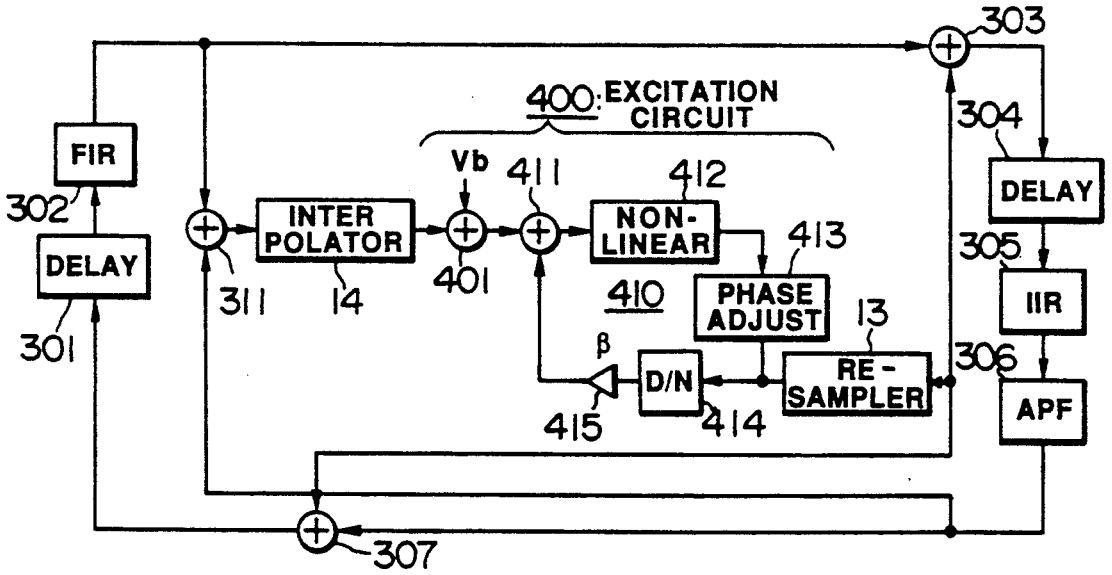
FIG. 9 is a block diagram showing the configuration of a musical tone synthesizing apparatus of the third preferred embodiment.

FIG. 9 is a block diagram showing the configuration of a musical tone synthesizing apparatus of the third preferred embodiment. This apparatus is designed to synthesize a musical tone of a non-electronic bowed string instrument such as a violin. In FIG. 9, delay circuit 301, FIR (Finite Impulse Response) filter 302, adder 303, delay circuit 304, IIR (Infinite Impulse Response) filter 305, all-pass filter 306 and adder 307 constitutes a loop circuit for simulating the operation of the string in the bowed string instrument. All delay circuits in this loop circuit are driven by a clock having a sampling frequency Fs. The output signals of FIR filter 302 and all-pass filter 306 are summed by adder 311. The output signal of adder 311, having sampling frequency Fs, is interpolated over time by interpolator 14. Interpolator 14 then outputs the interpolated signal having sampling frequency N*Fs. Excitation circuit 400 is provided to simulate the interaction between the bow and the string of the bowed string instrument. The output signal of interpolator 14 is added with signal Vb corresponding to the velocity of the movement of the bow by adder 401. The output signal of adder 401 is introduced to loop circuit 410 including adder 411, non-linear transformation circuit 412, phase adjust filter 413, delay circuit 414 having delay time 1/(N*Fs) and multiplier 415 having multiplication coefficient $\beta$ which is less than one. This loop circuit has a hysteresis input-output transformation characteristic which simulates the hysteresis characteristic of the movement of the string in response to the movement of the bow. The output signal of phase adjust filter 413 is converted into a signal having sampling frequency Fs by resampler 13. The output signal of resampler 13 is then supplied to adder 303 and 309. In this apparatus, an advantage similar to those obtained from the above-described preferred embodiments is obtained.

[E] Fourth preferred embodiment

Figure 10:
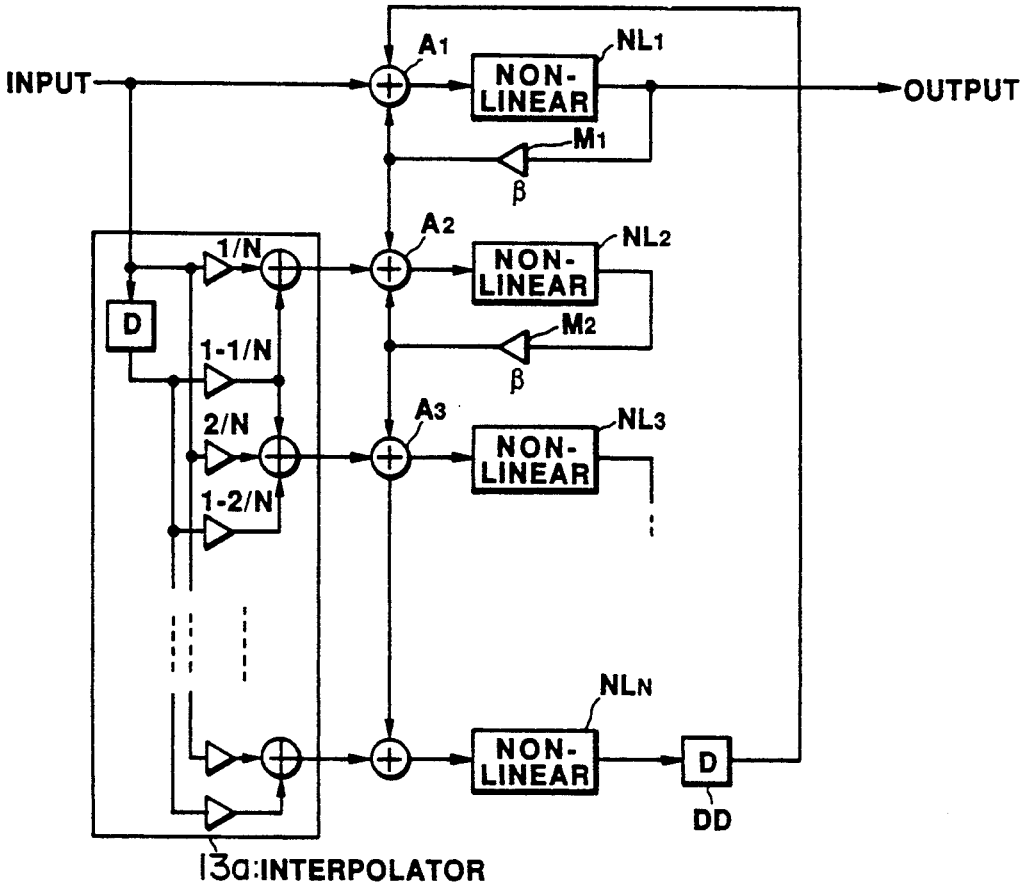
FIG. 10 is a block diagram showing the configuration of a musical tone synthesizing apparatus of the fourth preferred embodiment.
Figure 11:
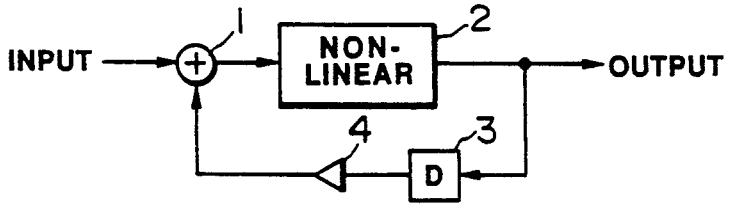
FIG. 11 is a block diagram showing a non-linear signal processing circuit employed in a conventional musical tone synthesizing apparatus.
Figure 12A:
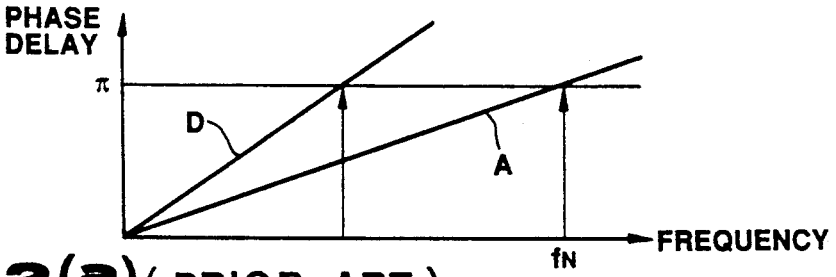
FIG. 12(a) ( PRIOR ART )
FIGS. 12A and 12B are charts, respectively showing a problem and its improvement in the musical tone synthesizing apparatus which employs the non-linear signal processing circuit shown in FIG. 11.
Figure 12B:
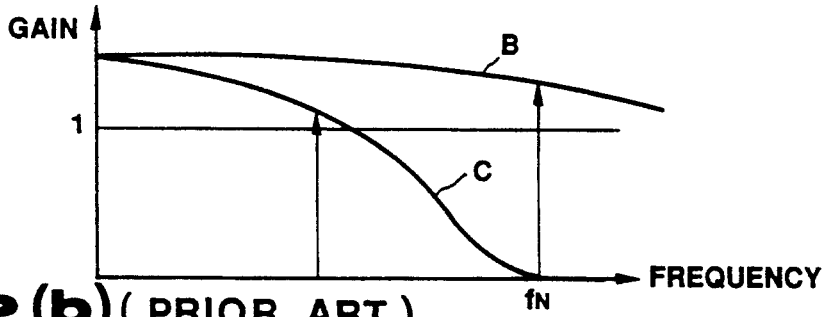
FIG. 12(b) ( PRIOR ART )

FIG. 10 is a block diagram showing the configuration of a musical tone synthesizing apparatus of the fourth preferred embodiment. In the musical tone synthesizing apparatuses of the second through fourth preferred embodiments, a sampling period (interval 1/Fs) is divided into N time slots, and N non-linear calculations are sequentially executed in synchronization with the changing of the time slot during a sampling period 1/Fs. In each time slots, non-linear calculation is executed using the calculation result obtained in the immediately previous time slot. In the musical tone synthesizing apparatus of the fifth preferred embodiment, non-linear transformation circuits $NL_1$ through $NL_N$ are provided in order to execute N non-linear calculations simultaneously in one sampling period 1/Fs in a parallel manner. The output signal of linear circuit (resonator circuit) is linear-interpolated by interpolator 14*a*. Interpolator 14*a* outputs N−1 interpolated samples, i.e., the sample corresponding to the value of the input signal at the time 1/(N*Fs) before the beginning of the sampling period, the sample corresponding to the value of the input signal at the time 2/(N*Fs) before the beginning of the sampling period, . . . and the sample corresponding to the value of the input signal at the time (N−1)/(N*Fs) before the beginning of the sampling period. On the other hand, the output signal of linear circuit is also supplied to adder $A_1$, and is thereby added with the output signal of delay circuit DD. First non-linear calculation is carried out on the output signal of adder $A_1$ by non-linear transformation circuit $NL_1$. The result of the first non-linear calculation output as the output signal of the excitation circuit, and is also supplied to multiplier $M_1$. Multiplier $M_1$ then carries out the first multiplication using coefficient $\beta$ on the result of the first non-linear calculation. Adder $A_2$ adds the sample corresponding to the value of the output signal of linear circuit at the time 1/(N*Fs) before the beginning of the sampling period, which is presented by interpolator 13*a*, with the result of the first multiplication output from multiplier $M_1$. The second non-linear calculation and the second multiplication, which are similar to those performed by non-linear transformation circuit $NL_1$ and multiplier $M_1$, are performed by non-linear transformation circuit $NL_2$ and multiplier $M_2$. Thereafter, similar to the above, the sample corresponding to the value of the output signal of linear circuit at the time i/(N*Fs) before the beginning of the sampling period, is added with the result of the ith multiplication output from multiplier $M_i$, after which the (i+1)th non-linear calculation is carried out on the added result by non-linear transformation circuit $NL_{i+1}$, with respect to i=3 to N−1. The result of the last non-linear calculation given by non-linear transformation circuit $NL_N$ is supplied to delay circuit DD and thereby delayed by one sampling period. The delayed signal is supplied to adder $A_1$. In this manner, the operations, which are sequentially performed in time sharing manner in the second through fourth preferred embodiments, are simultaneously performed in this embodiment. Accordingly, the advantages obtained from the second through fourth embodiments are obtained from the fifth embodiment without the use of either a high-rate sampling clock having sampling frequency N*Fs or a resampler.

The above-described fifth preferred embodiment is designed to simulate the signal transmission mode in which the vibration of the resonator is fed back to the excitation mechanism. When simulating a signal transmission mode with only one direction in which the excitation mechanism present the excitation vibration into the resonator, the connection between the linear circuit and the excitation circuit is not necessary. In this case, the input signal to the excitation circuit may be sample data of a predetermined waveform, the sampling frequency of which is Fs, for example.

The application of the present invention is not restricted in the above-described preferred embodiments. The present invention can be applicable to simulations of the tone generation mechanisms of the other instruments.

What is claimed is:

1. A musical tone synthesizing apparatus comprising:

linear signal processing means which carries out a linear signal processing including at least a delay operation on an input signal supplied thereto and outputs the result of the linear signal processing as an output signal in synchronization with a clock having a first frequency;

non-linear processing means which carries out a non-linear processing on an input signal supplied thereto and outputs the result of the non-linear processing as an output signal in synchronization with a high-rate clock having a second frequency greater than said first frequency; and resample means which converts the output signal of said non-linear signal processing means into a converted signal, the sampling frequency of which is said first frequency, and supplies the converted signal obtained by the conversion as said input signal to said linear signal processing means in synchronization with said clock having said first frequency;

whereby a signal picked up from said linear signal processing means is output as a musical tone signal.

2. A musical tone synthesizing apparatus according to claim 1 further comprising:

interpolation means for interpolating a signal picked up from said linear signal processing means over time to generate sample data, the sampling frequency of which is said second frequency, and for sequentially supplying the sample data to said linear signal processing means in synchronization with said high-rate clock, whereby said non-linear signal processing means carries out a linear signal processing using said input signal and the signal supplied by said interpolation means.

3. A musical tone synthesizing apparatus according to claim 1 wherein in the case where said first frequency is Fs and N is a integer number, said second frequency is determined as N*Fs.

4. A musical tone synthesizing apparatus comprising:

linear signal processing means which carries out a linear signal processing including at least a delay operation on an input signal thereto in synchronization with a clock having a predetermined frequency;

interpolation means for interpolating an input signal supplied thereto to generate sample data corresponding to the values of said input signal at a plurality of time points in a period corresponding to said predetermined frequency; and non-linear processing means which carries out a non-linear processing on said sample data and supplies the result to said linear signal processing means as said input signal, whereby a signal picked up from said linear signal processing means is output as a musical tone signal.

5. A musical tone synthesizing apparatus comprising:

non-linear processing means for, at a first rate, carrying out non-linear processing on an input signal applied thereto and outputting the result of the non-linear as a non-linear output signal;

resample means for converting said non-linear output signal into a converted signal having a second rate;

linear signal processing means for, at said second rate, carrying out a linear signal processing on said converted signal supplied thereto and making a linear process signal based on said linear signal processing, wherein said first rate is higher than said second rate; and picking up means for picking up said linear process signal from said linear signal processing means as a musical tone signal.

6. A musical tone synthesizing apparatus according to claim 5 further comprising:

interpolation means for interpolating sampled values of said linear process signal, at said first rate, over time and providing an interpolation signal based on the result of interpolation to said linear signal processing means as said input signal applied to the non-linear processing means.

7. A musical tone synthesizing apparatus according to claim 5 wherein said first rate is an integer multiple of said second rate.

8. A musical tone synthesizing apparatus comprising:

linear signal processing means which carries out a linear signal processing including at least a delay operation on an input signal supplied thereto in synchronization with a clock having a first frequency;

interpolation means for interpolating sampled values of said input signal to generate new sampled values positioned between said sampled values and generating, at a second frequency, an interpolation signal based on said sampled values and said new sampled values; and non-linear processing means for carrying out a non-linear processing on said interpolation signal at said second frequency and supplying, at said first frequency, the result to said linear signal processing means as said input signal, said second frequency being higher than said first frequency; and picking up means for utilizing a signal picked up from said linear signal processing means as a musical tone signal.

* * * * *